US008292073B2

(12) United States Patent
Thomas et al.

(10) Patent No.: US 8,292,073 B2
(45) Date of Patent: Oct. 23, 2012

(54) FITTING SYSTEM CART FOR GOLF CLUB HEADS AND SHAFTS

(75) Inventors: James S. Thomas, Ft. Worth, TX (US); Robert Lukasiewicz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 951 days.

(21) Appl. No.: 12/349,886

(22) Filed: Jan. 7, 2009

(65) Prior Publication Data

US 2010/0051505 A1 Mar. 4, 2010

Related U.S. Application Data

(60) Provisional application No. 61/094,302, filed on Sep. 4, 2008.

(51) Int. Cl.
*B60R 7/00* (2006.01)

(52) U.S. Cl. ..... 206/315.1; 206/315.2; 206/45.15; 206/45.18; 280/47.26; 280/47.19; 224/519; 224/661; 211/85.7; 211/70.6; D6/552; D6/477; D6/470; D6/467; D6/440

(58) Field of Classification Search ..... 206/315.1, 206/315.2, 45.15, 45.18; 280/769, 651, 47.34, 280/47.26, 47.19, 37; 224/661, 614, 584, 224/524, 519

See application file for complete search history.

(56) References Cited

U.S. PATENT DOCUMENTS 4,344,660 A * 8/1982 Molnar et al. ..... 312/249.13
5,234,114 A * 8/1993 Coffey ..... 211/70.2
2002/0193184 A1* 12/2002 Currie et al. ..... 473/409

* cited by examiner

*Primary Examiner* — Anthony Stashick
*Assistant Examiner* — Cynthia Collado
(74) *Attorney, Agent, or Firm* — Banner & Witcoff, Ltd.

(57) ABSTRACT

A fitting system cart is provided for golf club heads and shafts which have releasable connections between the golf club head and the shaft. The fitting system cart includes a base with a back panel, two side panels, and a top panel which all define an interior portion, a shaft container, and a set of golf club head cases. The fitting system cart may include two door panels connected to the base and movable between an open and closed position. The fitting system cart may include a set of cases for carrying golf club heads. The cases may have a bottom portion for holding golf club heads and a top portion connected to the bottom portion, wherein the top portion rotates between an open and a closed position. The shaft container may have a configuration wherein the shaft container is closed, and a configuration wherein the shaft container is open.

14 Claims, 11 Drawing Sheets

| | | FITTING OPTIONS | | | | |
|---|---|---|---|---|---|---|
| | | SHAFT | LIE | GRIP SIZE | LENGTH | BOUNCE* |
| COLOR CODE | GOLD | | +4 UP | | +2″ | |
| | WHITE | | +3 UP | +1/16″ | +1-1/2″ | |
| | GREEN | HIGH LAUNCH | +2 UP | +1/32″ | +1″ | HIGH |
| | BLUE | | +1 UP | +1/32″ | +1/2″ | |
| | YELLOW | MID LAUNCH | STD | STD | STD | MID |
| | ORANGE | | -1 FLT | -1/32″ | -1/2″ | |
| | RED | LOW LAUNCH | -2 FLT | | -1″ | |
| | SILVER | | -3 FLT | W STD | | |
| | PINK | | | W Ptte | | |

FITTING SYSTEM CART FOR GOLF CLUB HEADS AND SHAFTS

CROSS REFERENCE TO RELATED APPLICATION

This Non-Provisional Application claims benefit to U.S. Provisional Application Ser. No. 61/094,302 filed Sep. 4, 2008, the entire disclosure of which is hereby incorporated by reference.

FIELD OF THE INVENTION

This invention relates generally to golf clubs and golf club heads. More particularly, aspects of this invention relate to a fitting system cart for golf club heads and golf club shafts which have releasable connections between the golf club head and the shaft. The fitting system cart includes the cart, a shaft container, and a set of golf club head cases. The fitting system cart allows a golf club fitter or golf professional the ability to fit a specific golf club head and golf club shaft for individual golfers.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g. using handicapped scoring, different tee boxes, in team formats, etc.), and still enjoy the golf outing or competition. These factors, together with the increased availability of golf programming on television (e.g. golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular golfer's swing features or characteristics (e.g. club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g. draw biased club heads, fade biased club heads, neutrally weighted club heads, etc.). Additionally, the club heads may be combined with a variety of different shafts, e.g. from different manufacturers; having different stiffness, flex points, kick points, or other flexion characteristics, etc.; made from different materials; etc. Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

More recently, golf club fitters and golf professionals have been able to use golf clubs which have a releasable connection between the golf club head and the golf club shaft. Further, these golf clubs have head/shaft position adjusting features to allow easy interchange of shafts and heads and to allow easy modification of the head/shaft positioning properties. However, with the great number of combinations available to a golfer, this still may be a difficult task to organize and carry this equipment.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to a fitting system cart for use with golf club heads and golf club shafts. The fitting system cart in accordance with examples of this invention may include a base with a back panel, two side panels, and a top panel which all define an interior portion. The fitting system cart may also include two door panels which are connected to the base and movable between an open and closed position. The fitting system cart may also include a set of cases adapted to carry golf club heads. The case may have a bottom portion with an insert adapted to hold golf club heads and a top portion connected to the bottom portion, wherein the top portion is configured to be moved between an open and a closed position. The fitting system cart may also include a shaft container adapted to carry golf club shafts. The shaft container may have a first configuration wherein the shaft container is closed, and a second configuration wherein the shaft container is open. In one embodiment, the shaft containers further comprises a set of compartments to hold a set of golf club shafts, a cover that is connected to the compartments, and a stand connected to the compartments. In another embodiment, the interior portion of the fitting system cart may include storage areas for items that may assist a golf club fitter or golf professional.

Further aspects of the invention relate to a shaft container for golf club shafts. The shaft container has a first configuration where the shaft container is closed and a second configuration where the shaft container is open. Furthermore, the shaft container has a set of compartments which are adapted to carry golf club shafts. In one embodiment, there are four compartments, wherein there are two outer compartments and two inner compartments. The two outer compartments may be connected to the respective inner compartments, while the two inner compartments may be rigidly connected to each other. In the closed configuration, the two outer compartments are folded over the two inner compartments, forming a box-like structure. In the open configuration, the two outer compartments are folded open, so that the four compartments are standing in series next to each other. The shaft container may also include a cover that is rotatably connected to the compartments and a stand which is connected to the compartments and can be in a retracted configuration or an extended configuration.

In a further embodiment, as part of a kit, the golf club shafts may have a color-coded shaft grip cover in order to assist the club fitter or golf professional in selecting the correct shaft for a golfer. In yet an additional embodiment, the golf club shafts may have the detailed specifications, such as club type, shaft model and/or shaft flex listed on the shaft grip cover.

Further aspects of the invention include a display rack fitting system for use with golf club heads and golf club shafts. The display rack fitting system may include a display rack, a set of cases adapted to carry golf club heads, and a shaft container adapted to carry golf club shafts. The display rack may further include a base for setting the shaft container, and at least one support member attached to the base. The support members provide support to the display rack fitting system, as well as providing support for the shaft container. The support members may also provide a means to secure a set of shelves to store or hold the cases. In an embodiment, a display sign may be attached to the support members.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example carts, containers, and cases in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g. based on the example orientations shown in the figures and/or the orientations in typical use. Nothing in this specification should be construed as requiring a specific three dimensional or spatial orientation of structures in order to fall within the scope of this invention.

Figure 1A:
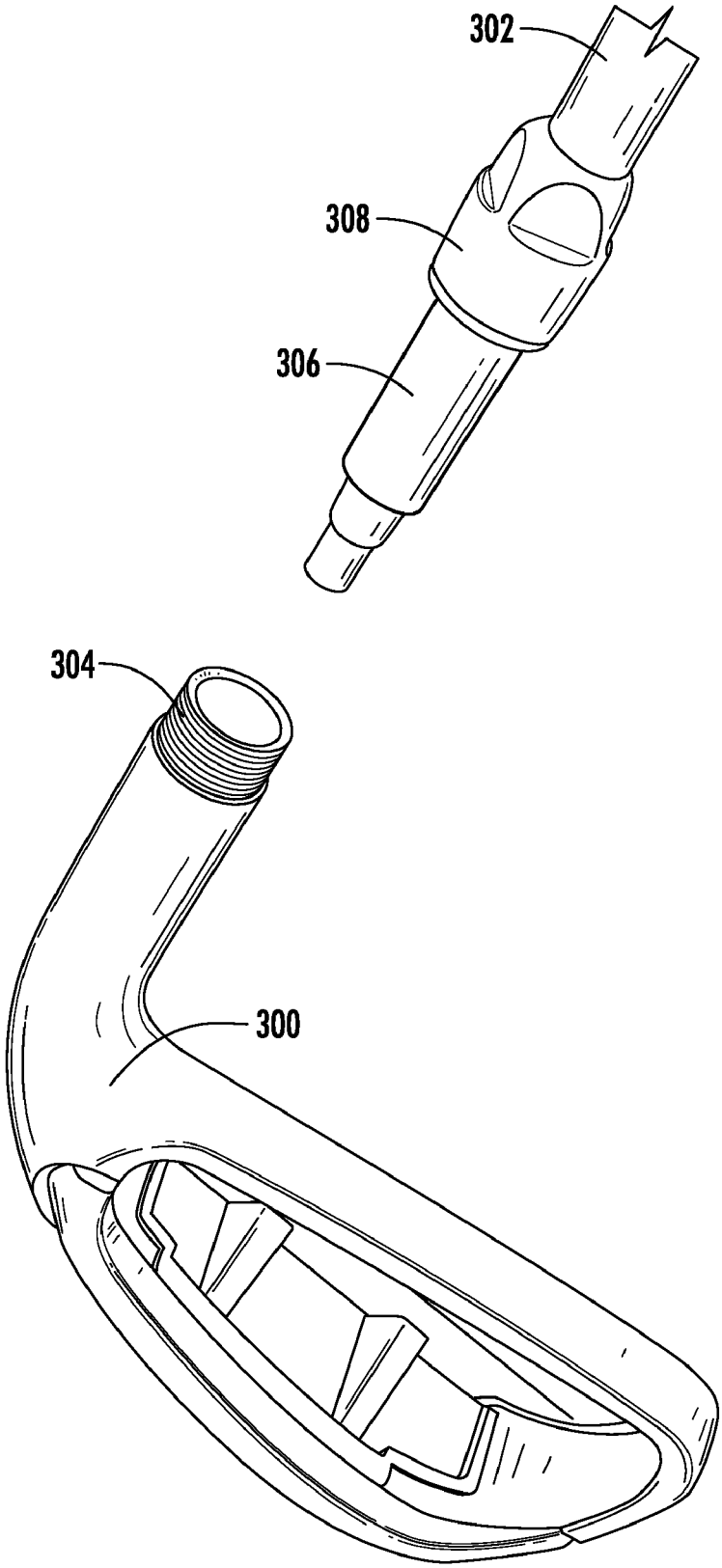
FIG. 1A generally illustrates a perspective view of an illustrative golf club head and golf club shaft which can releasably connected.
Figure 1B:
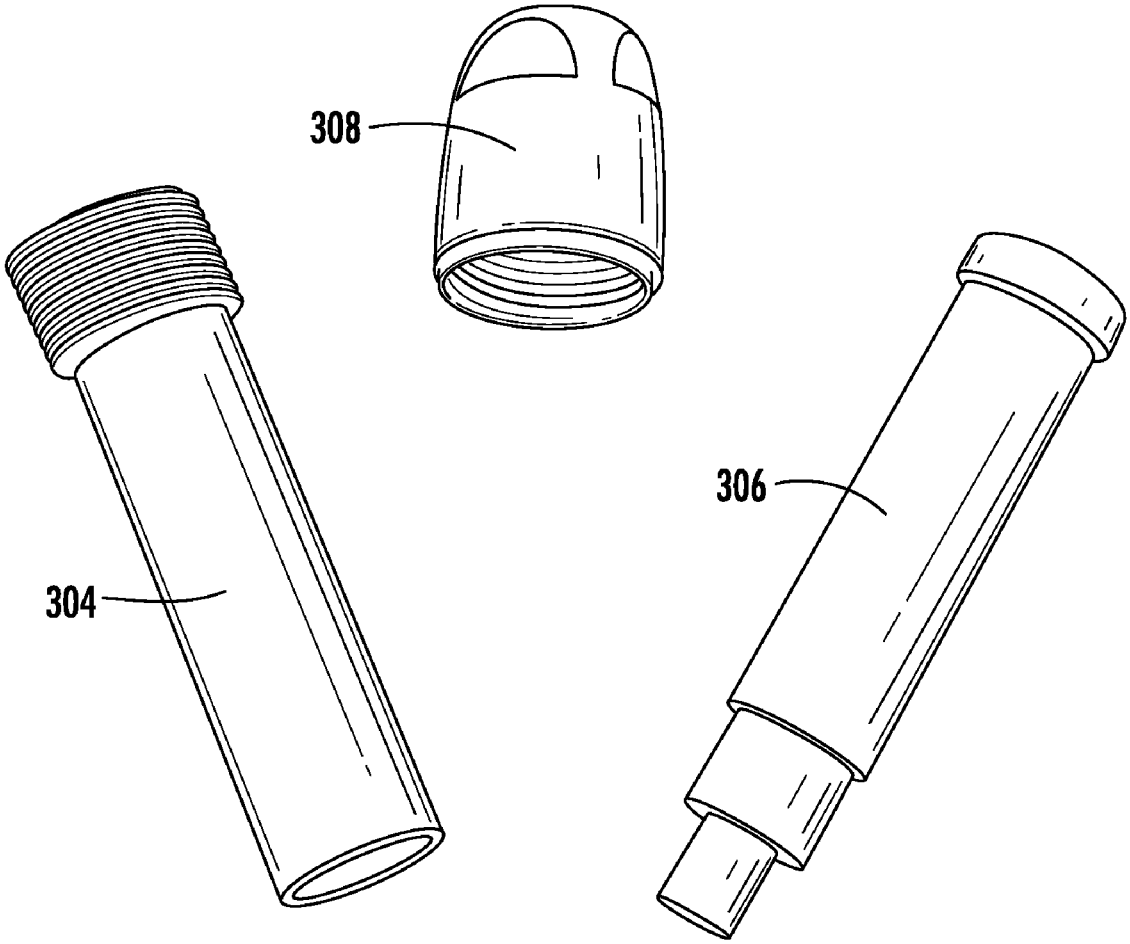
FIG. 1B generally illustrates a perspective view of the connections parts to releasably connect the golf club head and golf club shaft.

In general, as described below, aspects of this invention relate to systems and methods for connecting golf club heads to shafts in a releasable manner so that the club heads and shafts can be readily interchanged and/or repositioned with respect to one another. FIGS. 1A and 1B illustrate a sample system for connecting golf club heads to shafts in a releasable manner. In this illustrative example, a golf club head 300 is attached to a shaft 302 by means of a receiving member 304, a shaft adapter 306, and retaining member 308. This system may allow the golf club fitter and golf professional the ability to more easily assist the golfer to determine which golf club head and golf club shaft best fits the golfer.

Specific examples of the invention are described in more detail below. The reader should understand that these specific examples are set forth merely to illustrate examples of the invention, and they should not be construed as limiting the invention.

Examples of Specific Embodiments

A. Fitting System Cart for Golf Club Heads and Shafts

Figure 2:
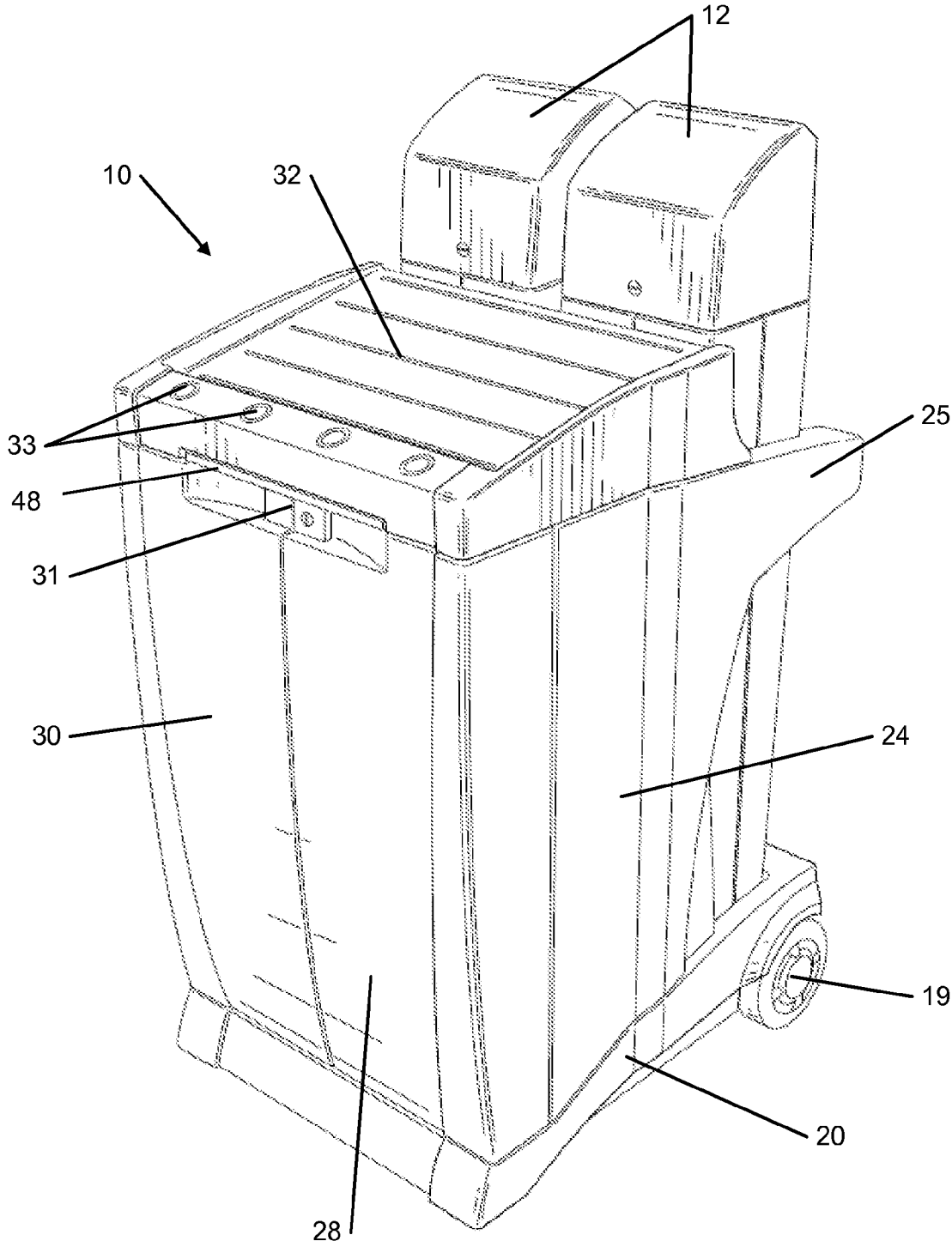
FIG. 2 illustrates a front perspective view of a golf club fitting cart according to illustrative embodiments of the invention.
Figure 3A:
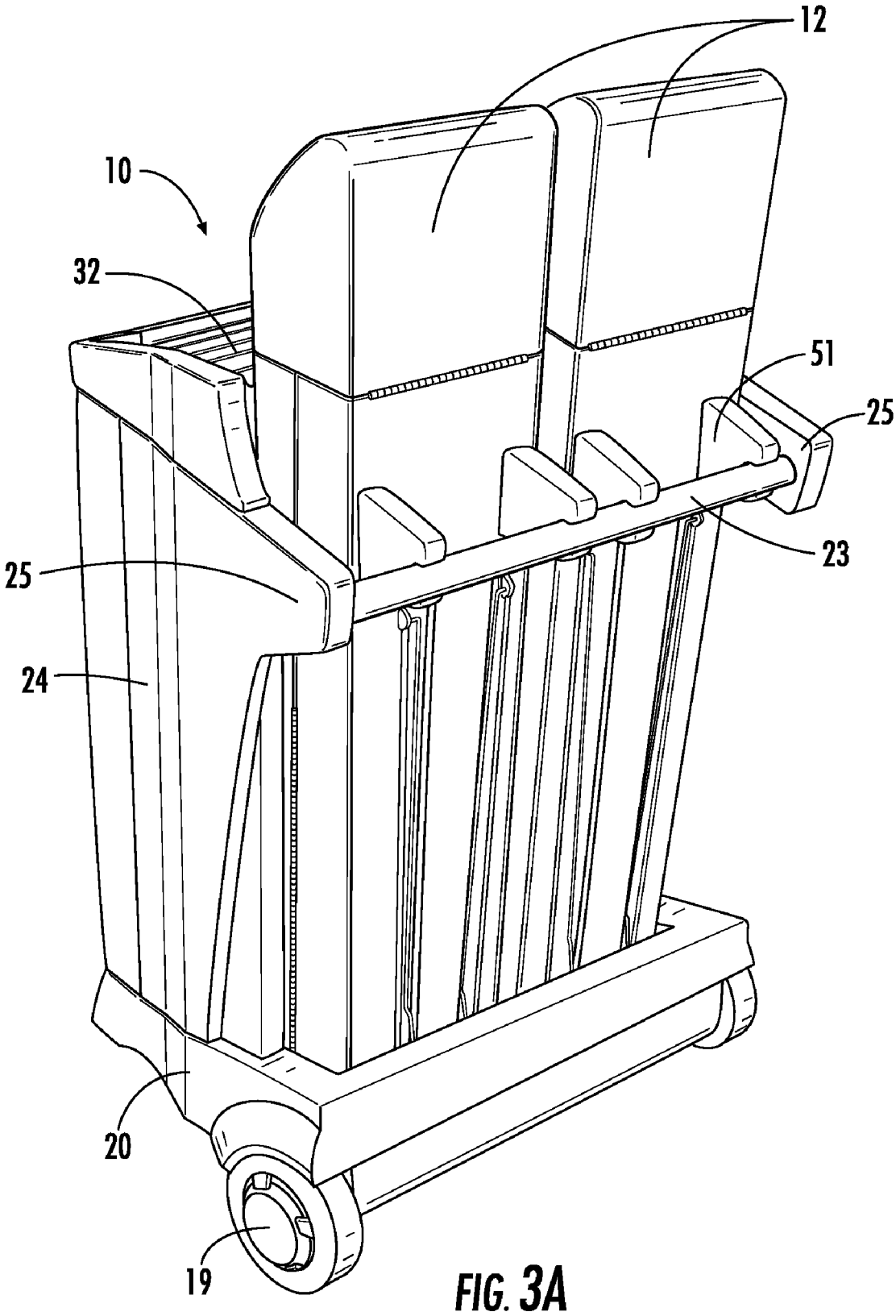
FIG. 3A illustrates a rear perspective view of the golf club fitting cart according to illustrative embodiments of this invention.
Figure 3B:
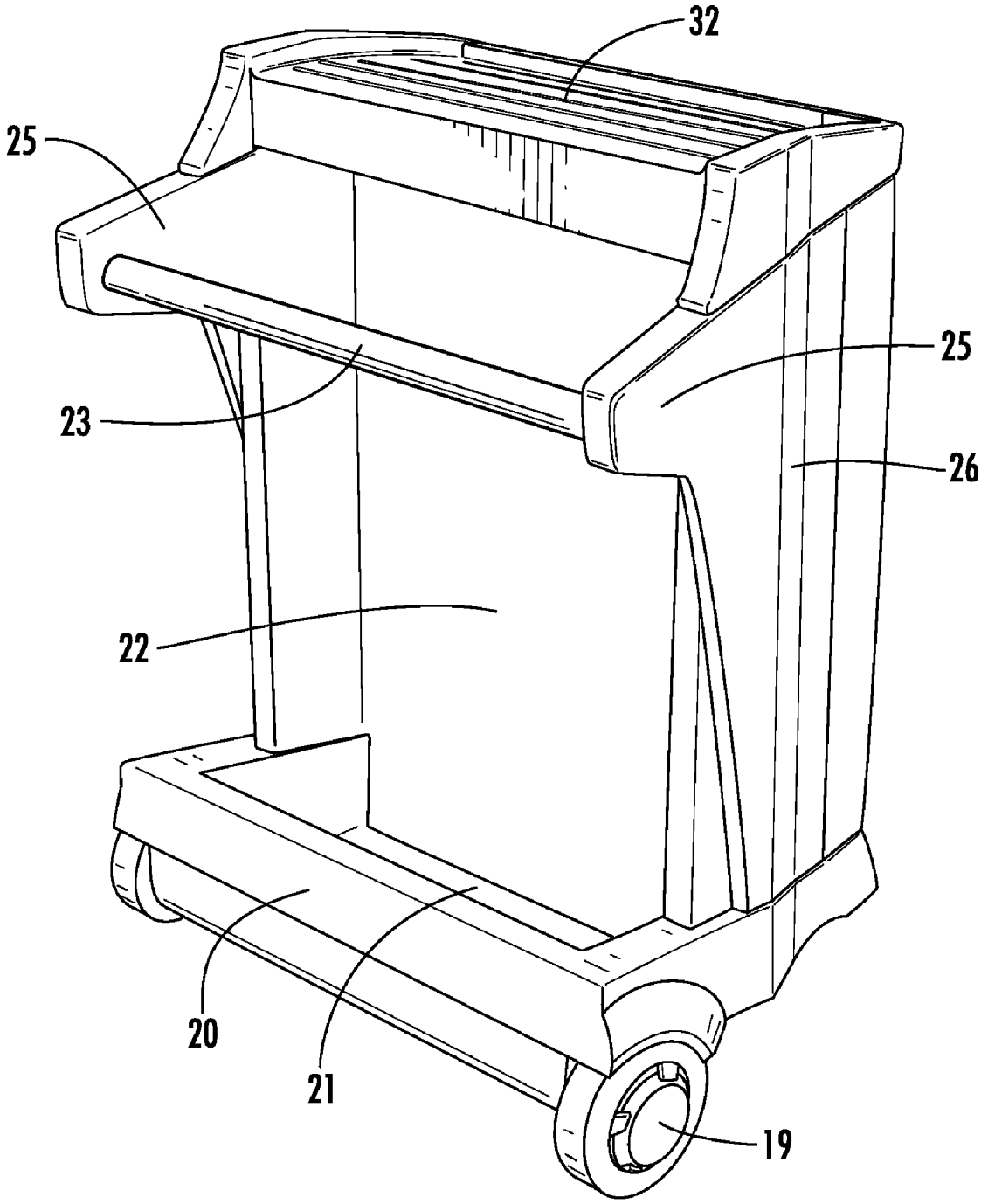
FIG. 3B illustrates a rear perspective view of the golf club fitting cart without a set of quivers according to illustrative embodiments of this invention.
Figure 4:
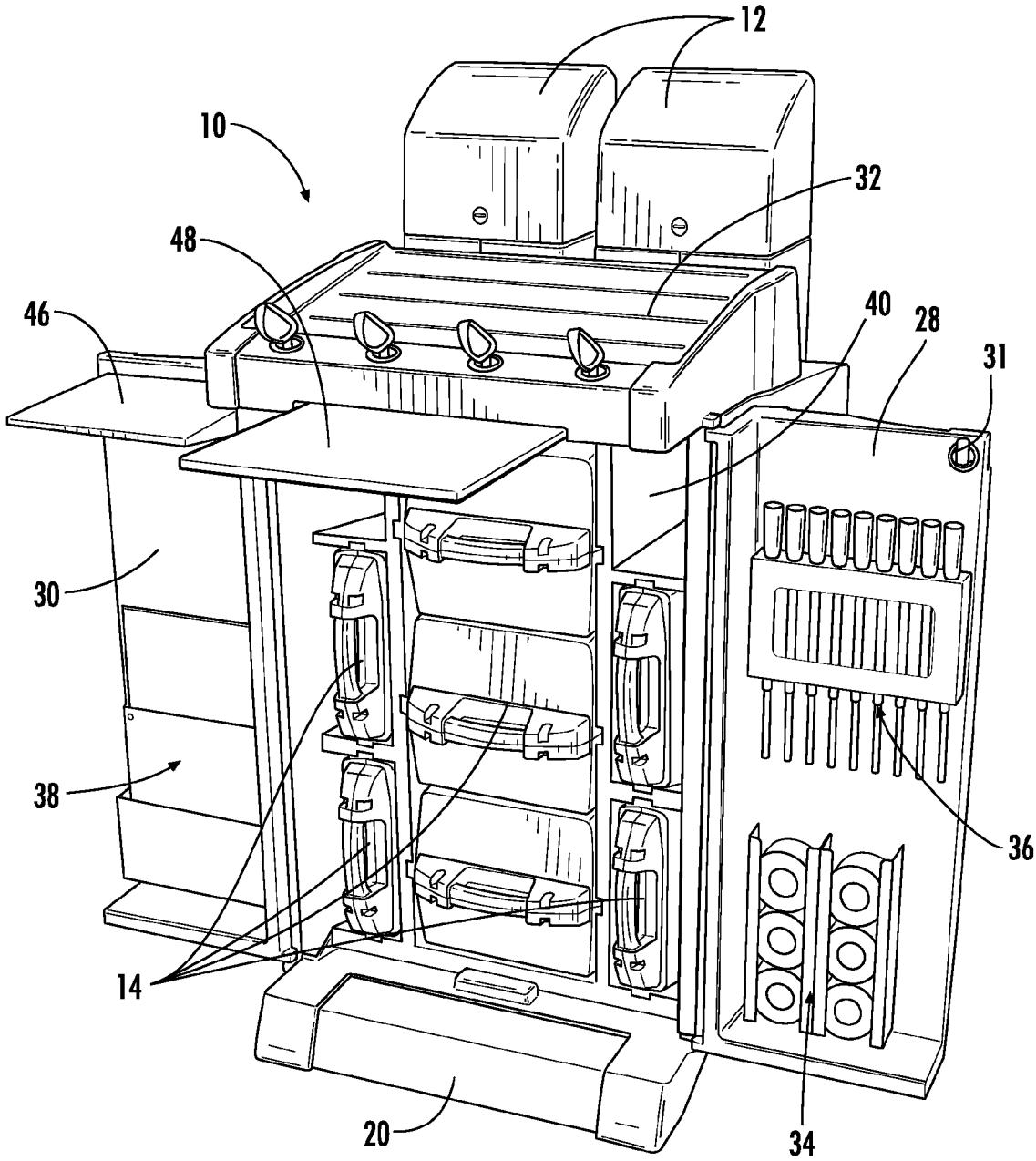
FIG. 4 illustrates a front perspective view of the golf club fitting cart with the doors opened according to illustrative embodiments of the invention.

FIGS. 2-4 generally depict an illustrative fitting system cart for golf club heads and shafts in accordance with at least some embodiments of the invention. The illustrative fitting system cart generally includes a cart 10, a set of quivers 12 and a set of cases 14. The set of quivers or shaft containers 12 are containers that may hold and store golf club shafts 70. (The terms "quiver" and "shaft container" are interchangeable throughout this application). As will be discussed in greater detail below, the quivers 12 can be positioned on the cart 10 or they may be removed from the cart 10. The cases 14 may hold a set of golf club heads which can then be attached to the golf club shafts. As will be discussed in greater detail below, the cases 14 may be located inside the cart 10 or removed from the cart 10.

1. Cart

The cart 10 generally includes a base 20, a back panel 22, a first side panel 24, a second side panel 26, a first door panel 28, a second door panel 30 and a top side panel 32, which connect together to form a box-like structure. The back panel 22, first side panel 24 and second side panel 26 extend upwardly and intersect with the base 20. The back panel 22, first side panel 24 and second side panel 26 may be perpendicular to the base 20 in order to intersect with the base 20. Within the base 20, there may be a cavity 21. The cavity 21 is approximately the size of the bottom of the quiver 12. The cavity 21 is where the quiver 12 is stored within the cart 10 proximal to the back panel 22.

The door panels 28, 30 may be connected to the base 20 and the side panel 24, 26 and extend upwardly and intersect with the base 20. The door panels 28, 30 may be perpendicular to the base 20 in order to intersect with the base 20. The door panels 28, 30 are movable from an open position and a closed position. The door panels 28, 30 may be equipped with a closing mechanism in order to ensure the door panels 28, 30 stay closed. Furthermore, the door panels 28, 30 may be equipped with a locking mechanism in conjunction with the closing mechanism in order to lock the interior of the cart 10. The door panels 28, 30 may provide storage capability for any number of items that might help the club fitter or golf professional when performing the club fitting session. Those items may include golf club shaft tape 34 for securing grips on the shaft, additional grips 36, or shaft tightening tools 38. Those of skill in the art will appreciate that additional items may be stored within the door panels 28, 30 and that the door panels 28, 30 may have additional storage configurations in order to store or hold items which the club fitter or club professional might use.

The base 20, back panel 22, side panels 24, 26, door panels 28, 30 and top panel 32 further define an interior to the cart 10. The interior may include storage compartments 40 to hold the club head cases 14, or other cases that may be included with the cart 10. Those of skill in the art will appreciate that between both the interior of the cart 10, the storage compartments 40, and the door panels 28, 30, there may be different combinations of storage capabilities as illustrated in this embodiment.

In a further aspect of the invention, a set of casters or wheels 19 is located at the bottom of the cart 10. The casters 19 may be located in the rear of the cart 10 along the base 20 of the cart 10. The casters 19 help provide mobility to the cart 10 and allow the golf fitter or golf professional the ability to more easily move the cart 10. The casters 19 may be made of a plastic or metal material or a combination thereof Those of skill in the art will appreciate that the casters 19 may be located in multiple places throughout the cart 10, and may be made of different materials.

In another aspect of the invention, the top panel 32 may have additional features. The top panel 32 may have a set of annular recesses 33 which may be sized and adapted to hold a golf club shaft. The annular recesses 33 may be used to hold a golf club so that the club fitter or golf professional may more easily work on a golf club and attaching, tightening, or adjusting the golf club head to the golf shaft. The top panel 32 may also have a tray 48 that slides out. The tray 48 may be located in a slot at the bottom of the top panel 32. The tray 48 may be pulled out from the front of the cart 10 in order to help facilitate the club fitter or golf professional during the club fitting process to provide a place to set parts or tools. Furthermore, the top panel 32 may be configured to be utilized as a work platform. For example, the top panel 32 may have grooves to help ensure tools and parts do not roll. Also, the top panel 32 may be in the form of a tray with side panels to ensure that the tools and parts are maintained on the top panel 32 and they do not fall off to the ground or floor.

In another aspect of the invention, there may be an arm 25 extended from each of the side panels 24, 26 directed towards the rear of the cart 10. A retaining bar 23 may be attached to each arm 25 spanning from one arm 25 to the other arm 25. Those of skill in the art will appreciate that the retaining bar 23 may be made of plastic or metal and may be of many different shapes and sizes, such as a round, bar-like structure, as well as a square or rectangular structure. The quivers 12 may also have a support structure 51 which provides support to ensure the quivers 12 are maintained in the cart 10.

The retaining bar 23 may provide a dual purpose. First, it helps to keep the quivers 12 in place as they are set in the back of the cart 10. Second, it provides a means to help the golf fitter or golf professional move the cart 10 from point A to point B. When the golf fitter or golf professional wants to move the cart 10, they might stand to the rear of the cart 10. Then, the golf fitter or golf professional may tilt the top of the cart 10 back towards them allowing the cart 10 to sit on the casters 19. This action may allow the golf fitter or golf professional to more easily roll the cart 10 from point A to point B. When the golf fitter or golf professional is at a location of choice, the golf fitter or golf professional can tilt the cart 10 back down to the standing position.

Furthermore, the retaining bar 23 may be releasably attached to the arms 25 in order to more easily facilitate removing the quivers 12 from the back of the cart 10. When the golf fitter or golf professional wants to remove the quivers 12 from the back of the cart 10, the golf fitter or golf professional may release the retaining bar 23 from the arm 25 in order to more easily slide the quivers 12 out from the back of the cart 10 as opposed to lifting the quivers 12 over the retaining bar 23 and out of the cart 10. Those of skill in the art will appreciate that the retaining bar 23 may be releasably attached to the arms 25 by any number of attachment means known in the art.

2. Quiver

Figure 5A:
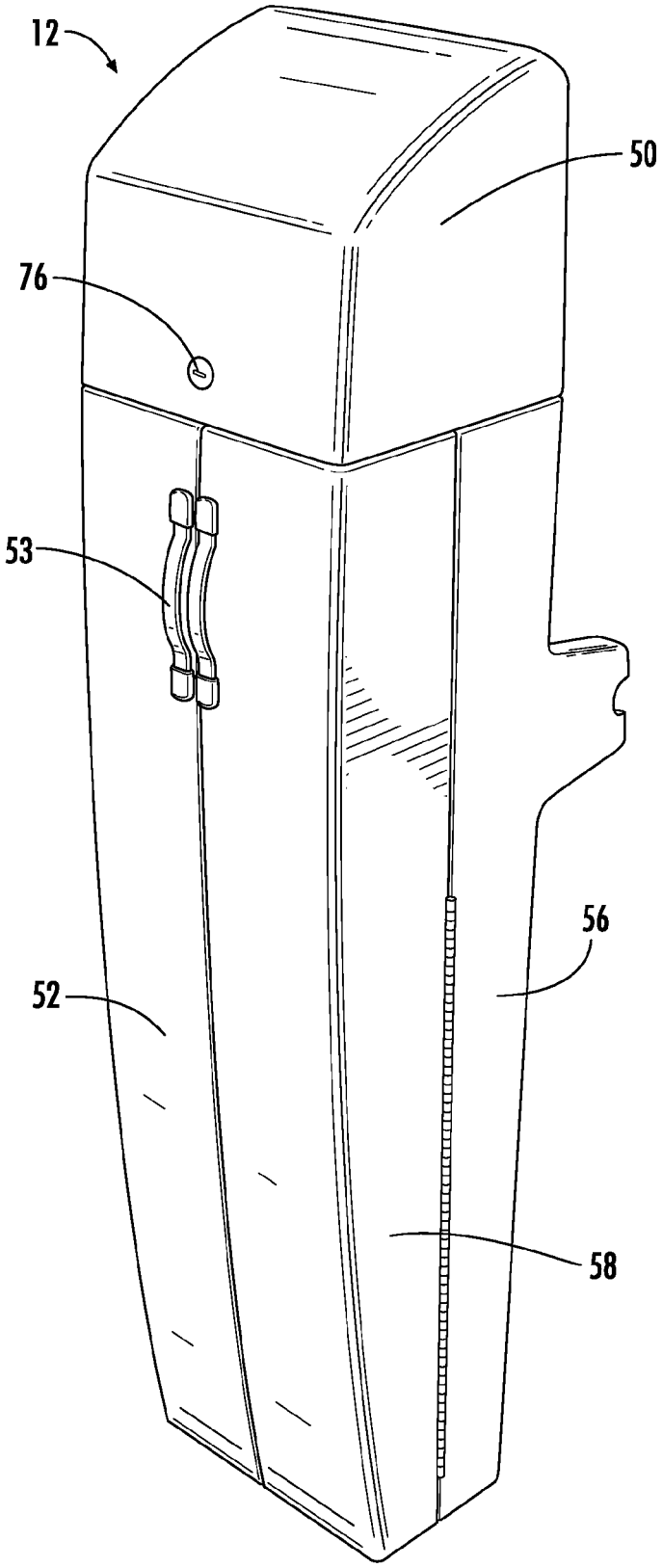
FIG. 5A illustrates a perspective view of a closed quiver according to illustrative embodiments of the invention.
Figure 5C:
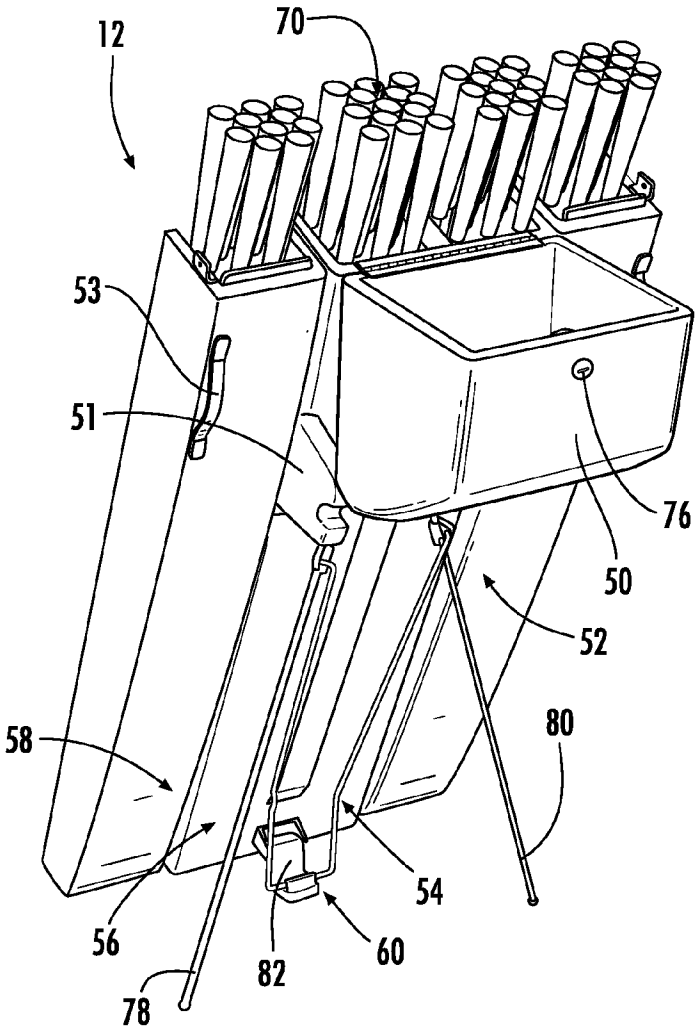
FIG. 5C illustrates a rear perspective view of the open quiver according to illustrative embodiments of the invention.
Figure 5B:
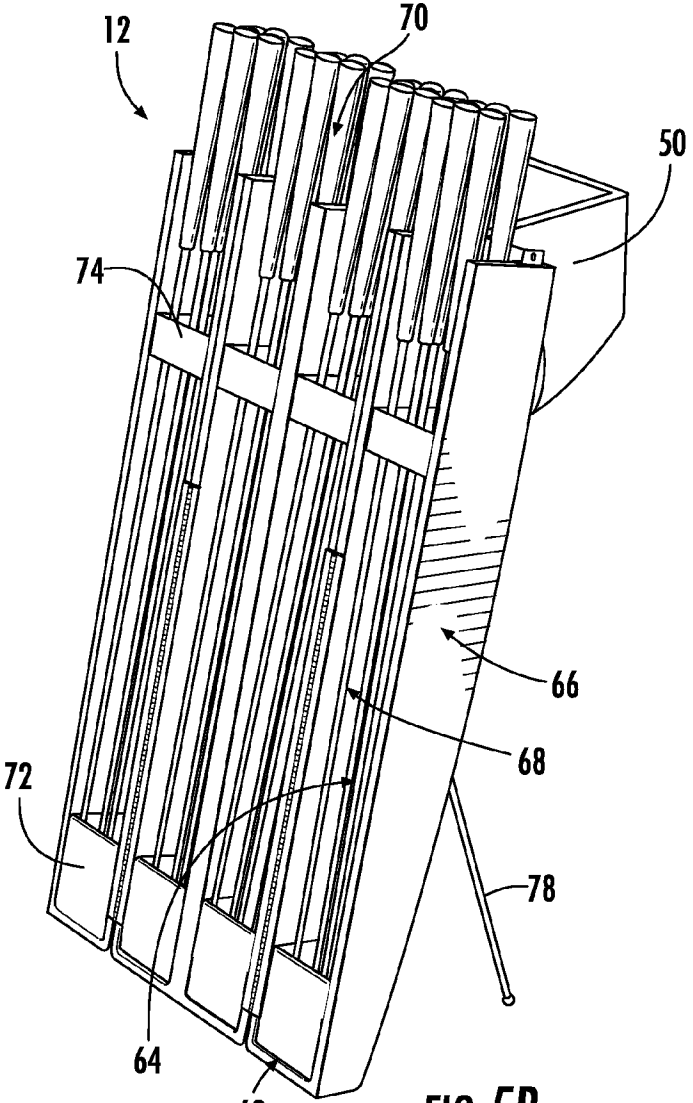
FIG. 5B illustrates a front perspective view of an open quiver according to illustrative embodiments of the invention.

As illustrated in FIGS. 5A-5C, the quiver 12 includes a set of compartments 52, 54, 56, 58, a cover 50, and a stand 60. The quiver 12 can be in a first configuration or a second configuration. In the first configuration, the quiver 12 is closed for storage or movement, while in the second configuration, the quiver 12 is open and can be used for club fitting by the golf fitter or golf professional.

The quiver 12 includes the set of compartments 52, 54, 56, 58 which are adapted to each individually hold a set of golf club shafts 70. Each compartment 52, 54, 56, 58 includes a baseplate 62, a back wall 64, a first side wall 66 and a second side wall 68, which connect together to form a box-like structure. The first side wall 66, second side wall 68 and back wall 64 extend upward and connect to the baseplate 62. The first side wall 66, second side wall 68, and back wall 64 may be perpendicular to the baseplate 62 in order to intersect with the baseplate 62. To help keep the golf club shafts 70 inside the compartment 52, 54, 56, 58, each compartment 52, 54, 56, 58 may include a lower retaining portion 72 and/or a middle retaining portion 74. The lower retaining portion 72 and middle retaining portion 74 may span from the front edge of the first side wall 66 to the front edge of the second side wall 68. The lower retaining portion 72 may be located proximate to the baseplate 62 near the bottom of the quiver 12, while the middle retaining portion 74 may be located at least more than halfway up the compartment 52, 54, 56, 58. Those of skill in the art will appreciate that there are be multiple methods to keep the golf shafts 70 inside the compartment 52, 54, 56, 58, such as having more than two retaining portions, having one large retaining portion, or having a inside retaining wall.

The compartments 52. 54, 56, 58 are attached to each other to form the quiver 12. In the illustrated embodiment in FIG. 5B, there are four compartments. The compartments 52, 54, 56, 58 are attached to each other in series, such that the first compartment 52 is attached to and proximal to the second compartment 54, which is attached to and proximal to the third compartment 56, which is finally attached to and proximal to the fourth compartment 58. The first compartment 52 is rotatably attached to the second compartment 54, while the fourth compartment 58 is also rotatably attached to the third compartment 56. The second compartment 54 and third compartment 56 may be rigidly attached to each other. A closing or locking mechanism may be provided on the first compartment 52 and the fourth compartment 58 to help secure and/or lock the compartments together (not shown in the figures).

The cover 50 may be rotatably attached to the middle two compartments, the second compartment 54 and third compartment 56. The cover 50 may be located at the top of the compartments 52, 54, 56, 58. The cover 50 may have a locking mechanism 76 in order to lock or close the quiver 12. The cover 50 may be sized in order to accept the golf club head cases 14 in order to provide a work station to place the case 14 on for the club fitter or golf professional. Furthermore, the stand 60 may be attached to the middle two compartments, the second compartment 54 and third compartment 56. The stand 60 may be located underneath the cover 50. The stand 60 can be extended to provide standing support for the quiver 12. Also, the stand 60 may be withdrawn and folded when the quiver 12 is not standing. The stand 60 can include two or more legs 78, 80 to help provide the standing support. Also, there may be an extending mechanism 82 included with the stand 60. The extending mechanism 82 may automatically extend the stand 60 when the quiver 12 is placed on the ground in an angled configuration. Conversely, when the quiver is picked up from the ground and sitting upright, the extending mechanism 82 may then automatically retract the stand 60 to its folded or closed position. The extending mechanism 82 may operate very similar to the stand mechanism currently in use on most standing golf bags designed to be carried.

As shown in FIG. 5A, the quiver 12 is in the first configuration and configured to be stored or carried. In the first configuration, the first compartment 52 and fourth compartment 58 are rotated over the second compartment 54 and third compartment 56 respectively to form a box or rectangular structure. When the first compartment 52 and fourth compartment 58 are rotated in the first configuration or closed configuration, the closing mechanism or locking mechanism provided on the first compartment 52 and fourth compartment 58 may secure and/or lock these compartments together (locking mechanism not shown in the figures). While in the first configuration, the first compartment 52 and fourth compartment 58 may be locked using the locking mechanism and a key.

Further, while in the first configuration, or closed configuration, the cover 50 is folded over the compartments 52, 54, 56, 58. A locking mechanism or closing mechanism 76 may also be provided on the cover 50, as shown in FIG. 5A, in order to lock or close the quiver 12. The action of using a key to lock the locking mechanism may secure the quiver system 12 as a whole, to include the compartments 52, 54, 56, 58 and the cover 50. Furthermore, in the first configuration or closed configuration, the stand 60 is retracted and not extended outward.

While in the second configuration, or open configuration, as shown in FIGS. 5B and 5C, the quiver 12 is configured to be used by the club fitter or golf professional. In the second configuration, the quiver 12 may be set down on the ground in order to extend the stand 60. The stand 60 will extend when the quiver 12 is set on the ground and angled back and the extending mechanism 82 is engaged with the ground. The stand 60 will help support the quiver 12 in the standing position. The cover 50 may then be rotated away from the compartments 52, 54, 56, 58. In order to do this, the locking mechanism 76 on the cover 50 may be unlocked in order to rotate the cover 50. The rotated cover 50 may then rest in a horizontal position against the back of the second compartment 54 and third compartment 56 in order to provide a work station to the club fitter or golf professional to place the golf club case 14. Once the cover 50 is rotated back, the first compartment 52 and fourth compartment 58 may be rotated away from the second compartment 54 and third compartment 56, so that the all compartments 52, 54, 56, 58 are aligned in series as shown in FIGS. 5B and 5C. This configuration provides the club fitter or golf professional the ability to more easily select a shaft from the quiver 12 to help facilitate the golf club fitting session.

3. Golf Club Head Case

FIGS. 8A-8D illustrate two illustrative cases for golf club heads to be used with the fitting system cart 10: a driver-head case 80 and an iron-head case 100. The driver-head case 80 may be bigger than the iron-head case 100 because of the size difference between the driver golf club head 82 and the iron golf club head 102. Normally, the driver case 80 will hold twelve to eighteen driver heads 82 and the iron case 100 will hold twelve to sixteen iron heads 102. The cases 80, 100 generally have a bottom portion 84, 104 and a top portion 86, 106. The bottom portion 84, 104 may have an insert 88, 108 with golf club head cut-outs 90, 110 in order to secure the golf club heads 82, 102 within the case 80, 100. The insert 88, 108 may be made of foam or plastic-type material, or any other material that can adequately secure the golf club heads 82, 102 in the case. The top portion 86, 106 may also have an insert 94, 114 with golf club head cut-outs, for example with the driver head case 80. The insert in the top portion 86, 106 may not have club head cut-outs 90, 110 (e.g. usually with the iron club head 102) and may be used solely for providing packaging support. However, the insert in the top portion 86, 106 may have club head cut-outs 90, 110 (e.g. usually with the driver club head 82).

The top portion 86, 106 may be connected to the bottom portion 84, 104 so that the top portion 86, 106 can rotate along a set of hinges to close the case 80, 100. Those of skill in the art will appreciate that there are various other ways the top portion 86, 106 may be connected to the bottom portion 84, 104 in order to allow the rotation for opening and closing the case 80, 100. The bottom portion 84, 104 and top portion 86, 106 may form a handle 92, 112 when the case 80, 100 is closed in order to more easily transport the case 80 100. The case 80, 100 may have a locking portion on the front of the case 80, 100 which could either be included with the handle 92, 112 or separate from the handle 92, 112 (not shown). Both the driver head case 80 and the iron head case 100 may be sized such that they can be placed in the cover 50 of the open quiver 12 to be used as a work station.

B. Display Rack Golf Club Fitting System

Figure 9:
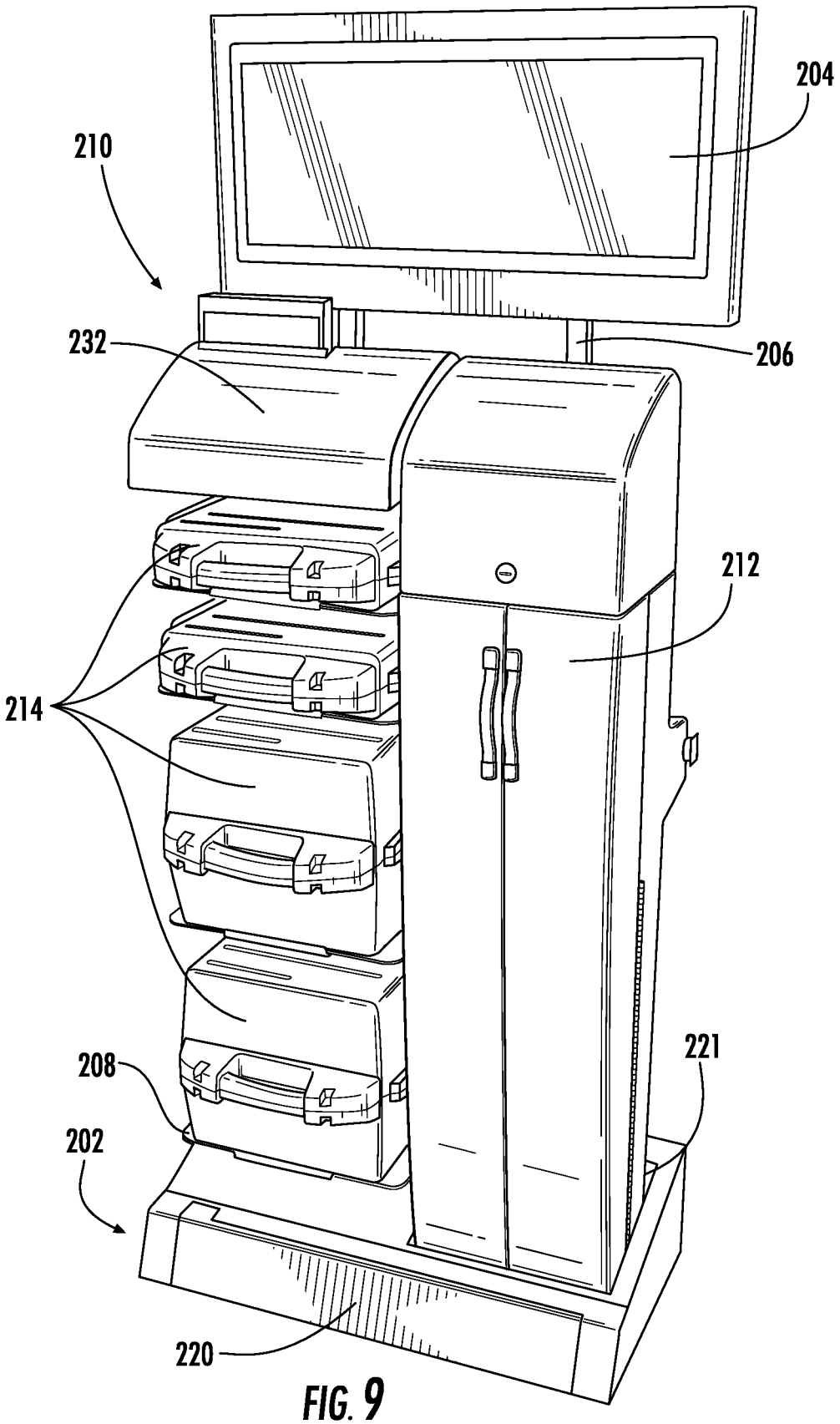
FIG. 9 illustrates a perspective view of a display rack fitting system according to illustrative embodiments of the invention.

A display rack golf club fitting system 210 is illustrated in FIG. 9. The display rack fitting system 210, may be used in a golf store, golf course pro shop, or any other facility that provides club fitting. The display rack fitting system 210 may be used by a golf club fitter or golf professional to more easily determine the golf club's specifications for a golfer. The display rack fitting system 210, as illustrated in FIG. 9, includes a quiver 212, a set of cases 214, and a display rack 202. The quiver 212 and the cases 214 may be very similar to those described above for the fitting system cart 10.

The display rack 202 may include a base 220, one or more support members 206, and a display sign 204. The base 220 may set on the ground or floor and provide both vertical and horizontal stability for the display rack fitting system 210 and ensure that the display rack fitting system 210 does not tip over. The support members 206 may be attached to the rear area of the base 220 and extended vertically upward and intersect with the base 220. The support members 206 may be perpendicular to the base 220. There may be one or more than one support member 206 in order to intersect with the base 220. The display sign 204 may be attached to the top of the support members 206. The display sign 204 may be a touch sensitive display or display monitor, which is coupled to a processor for providing information. The information may include golf club fitting information that may be helpful for the club fitter or golf professional when fitting the golfer with the golf clubs. The information may also include marketing information, which may be directed towards the golfer in order to provide details about the golf clubs, such as prices, benefits, and advantages to a certain brand of golf clubs. Those of skill in the art will appreciate that numerous methods of connection or attachment means may be used to connect the support member 206 to the base 220 and the display sign 204 to the support member 206.

Within in the base 220, there may be a cavity 221. The cavity 221 is approximately the size of the bottom of the quiver 212. The cavity 221 is where the quiver 212 is stored within the display rack fitting system 210 proximal to the set of golf club head cases 214. When the club fitter or golf professional wants to use the quiver and select a golf club shaft, they can simply lift the quiver 212 from the display rack fitting system 210 and remove the quiver 212. The club fitter or golf professional can then open the quiver 212 as described above and illustrated in FIGS. 5B and 5C. While the quiver 212 is located in the display rack fitting system 210, the quiver 212 may be attached to the support member 206 (attachment not shown). This will help ensure that the quiver 212 does not accidentally fall or tip from the display rack fitting system 210 prematurely.

The golf club head cases 214 may be located next to or proximal to the quiver 212, on the display rack fitting system 210. These cases 214 are described in detail above, and they may be configured very similar to as described above and in FIGS. 8A-8D. The cases 214 may be located on various shelves 208 on the display rack fitting system 210. The shelves may be attached to the support members 206 in order to hold the cases 214. In FIG. 9, there are two driver head cases and two iron head cases. Those of skill in the art will appreciate that there can be many different configurations of golf club head cases 214 for the display rack fitting system 210.

As shown in FIG. 9, the display rack fitting system 210 may also include a work panel 232. The work panel may be located next to the quiver 212 and above the cases 214. The work panel may be used by the club fitter or golf professional to assist with the fitting process, such as working on a club head, attaching a club head to a shaft, etc. The work panel may also hold brochures or pamphlets about the specific golf club being displayed. The work panel 232 may also be configured to include a top cover that opens to an area which can be used to store tools or golf club shaft tape, etc. in order to assist the club fitter or golf professional.

The display rack fitting system 210 may also include a display sign 204. The display sign 204 may be located at the top of the display rack fitting system 210 to help golfers or prospective buyers see the golf clubs and the display rack fitting system 210. The display sign 204 may be used to communicate product information to the golfer, such as product features, product options, or other product marketing information.

The display rack fitting system 210 as described above and illustrated in FIG. 9 may be in many different configurations. For example, the display rack fitting system 210 may include two quivers 212 (or more), two columns of cases 214 (or more), additional support members 206, etc. Also, the location of the quivers and cases may be different than as illustrated in FIG. 9. Those of skill in the art will appreciate that the display rack fitting system 210 can be in many different configurations of quivers 212, cases 214, and support members 206.

The club fitting cart 10 (FIG. 2) and display rack fitting system 210 (FIG. 9) of the present invention provides several benefits and advantages. The club fitting cart and display rack fitting system may be used as part of a larger mobile fitting system, which may include a laptop and launch monitor, intelligent fitting system software, and a unified fitting philosophy. The laptop, launch monitor, and intelligent fitting system software may provide immediate feedback to a club fitter or golf professional about a golfer's swing and ball flight pattern with respect to a golf club with specific characteristics. The club fitter or golf professional may then make immediate adjustments by using the club fitting cart 10 or display rack fitting system 210 of the present invention to change the components of the golf club, such as the shaft or club head.

Additionally, the cases as they are designed provide quick access to the fitting components for the golf club fitter or golf professional in order to improve the efficiency of the golf-fitting experience. Also, because the cases are sized such that they can be placed into the open quiver (self-standing) to be used as a work station. This also can improve efficiencies by freeing up work space for the golf club fitter. Both the individual cases and the quivers can be transported to the golf range or training next easily to allow for a quick fit component for expert fitters. Sometimes it is hard to transport all the tools to do a simple driver fit. However, with the cases and quivers, the tools required are right on hand.

C. Kits

Indeed, as one example, one or more elements or components of a fitting system cart for golf clubs may be marketed, sold, or utilized as a kit. In one such embodiment of a kit that is directed towards the fitting system cart, the kit may include a set of golf club shafts, a shaft container configured to hold the set of golf club shafts, a set of golf club heads configured to be releasably connected to the golf club shafts, a set of golf club head cases configured to hold the set of golf club heads, and a fitting system cart configured to carry the shaft container and golf club head cases.

In another embodiment of a kit that is directed towards a shaft container, the kit may include a set of golf club shafts, and a shaft container configured to hold the set of golf club shafts. The shaft container may further include a set of compartments adapted to each individually hold the golf club shafts, a cover connected to the compartments, and a stand connected to the compartments adapted to be in a retracted configuration or an extended configuration.

In another embodiment of a kit that is directed towards a display rack fitting system, the kit may include a set of golf club shafts, a shaft container configured to hold the set of golf club shafts, a set of golf club heads configured to be releasably connected to the golf club shafts, a set of golf club head cases configured to hold the set of golf club heads, and a display rack. The display rack may further include a base, at least one support member connected to the base and a display connected to the top of the at least one support member.

Figures 6, 7:
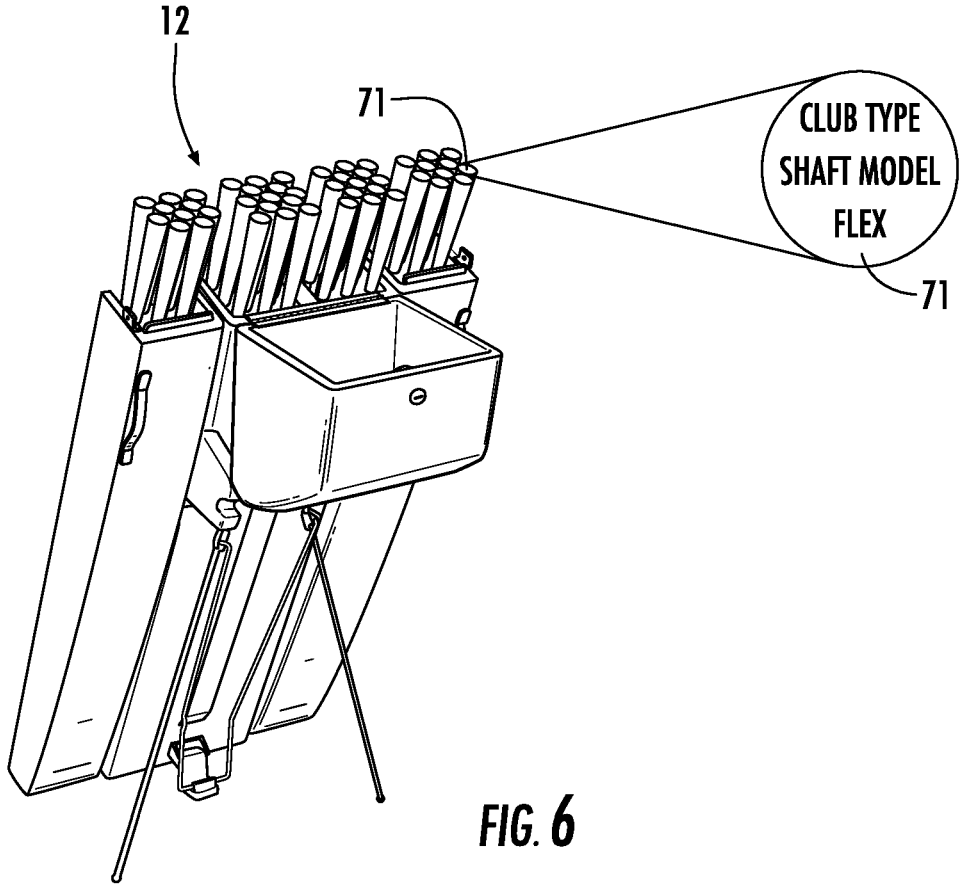
FIG. 6 depicts an illustrative view of a golf shaft grip cap according to illustrative embodiments of the invention.
FIG. 7 illustrates a table of sample configurations for the golf shaft grip cap fitting options.
Figure 8A:
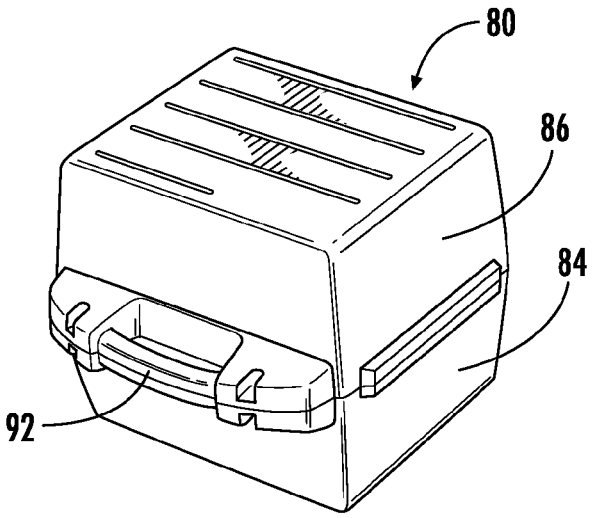
FIGS. 8A-8D illustrate perspective views of a golf club head case according to illustrative embodiments of the invention.
Figure 8B:
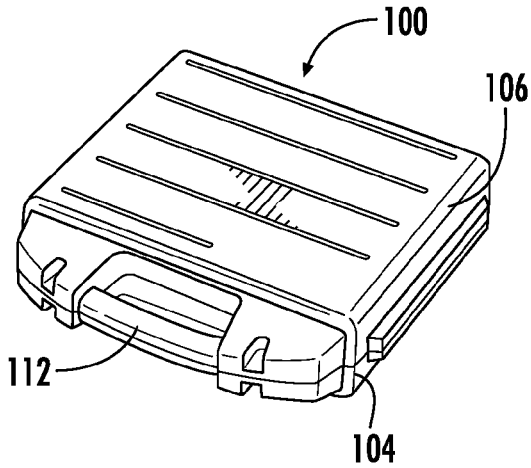
Figure 8C:
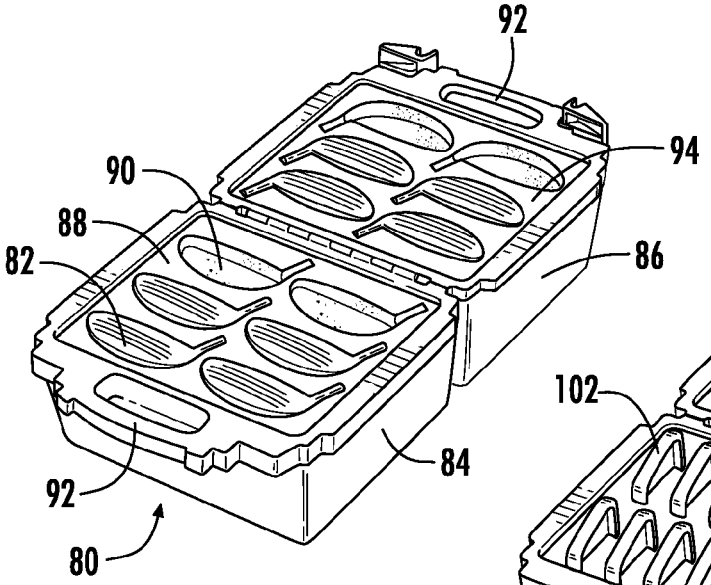
Figure 8D:
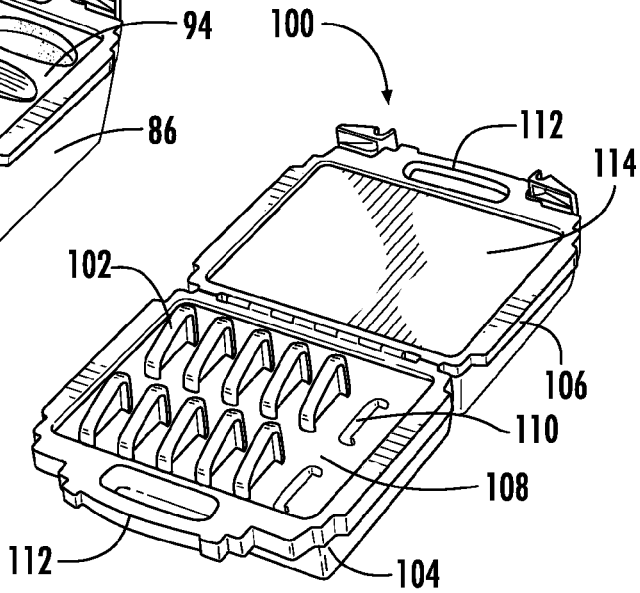

In each of these embodiments of a kit, the golf club shafts may have features that can help facilitate the golf club fitting session. One such feature could be color-coded grip caps as shown in FIG. 6. A grip cap 71 is located at the top of the shaft, on the end of the grip. The grip caps 71 could be color-coded in order to help facilitate club selection, such as green, yellow, or red. Green could mean a high launch shaft, yellow could mean a mid launch shaft, and red could mean a low launch shaft. Those of skill in the art will appreciate that additional colors may be used, as well as any type of color-coded combinations. In addition to the colors, the grip cap 71 could also be used to identify additional specific shaft specifications, such as club type, shaft model, and shaft flex, as illustrated in FIG. 6. Other specifications may be listed on the grip cap 71 as required or desired to help facilitate the club fitting experience. The table in FIG. 7 is an illustrative example of some possible combinations of specifications and colors for an aspect of this invention.

Conclusion

While the invention has been described in detail in terms of specific examples including presently preferred modes of carrying out the invention, those of skill in the art will appreciate that there are numerous variations and permutations of the above described systems and methods. Thus, the spirit and scope of the invention should be construed broadly as set forth in the appended claims.

We claim:

1. A fitting system cart for use with golf club heads and golf club shafts comprising:

a base;

a back panel connected to the base, the back panel extending upward, intersecting with the base;

a first side panel connected to the base and the back panel, the first side panel extending upward, intersecting with the base;

a second side panel connected to the base and the back panel, the second side panel extending upward, intersecting with the base;

a top panel connected to the first side panel, the second side panel, and the back panel;

a first door panel connected to the base and the first side panel, the first door panel extending upward, intersecting with the base, wherein the first door panel is movable between an open position and a closed position;

a second door panel connected to the base and the second side panel, the second door panel extending upward, intersecting with the base, wherein the second door panel is movable between an open position and a closed position;

an interior portion defined by the base, first side panel, second side panel, and top panel, wherein the interior portion includes a set of storage compartments;

a set of cases adapted to carry golf club heads, the set of cases inserted into the storage compartments, wherein each case comprises:

a bottom portion having an insert adapted to hold golf club heads, a top portion connected to the bottom portion, wherein the top portion is a shaft container adapted to carry golf club shafts, wherein the shaft container is located proximal to the back panel on the base, the shaft container having a first configuration and a second configuration, wherein in the first configuration, the shaft container is closed, and wherein in the second configuration, the shaft container is open, and further wherein the shaft container comprises:

a set of compartments adapted to each individually hold a set of golf club shafts, a cover connected to the compartments, the cover is sized to fit the case, and a stand connected to the compartments adapted to be in a retracted configuration or an extended configuration.

2. The fitting system cart of claim 1, wherein the base further includes a set of wheels attached to the base.

3. The fitting system cart of claim 1, wherein the cart includes a slidable tray which slides from the top panel.

4. The fitting system cart of claim 1, wherein the top panel includes a set of annular recesses adapted to receive a golf club shaft.

5. The fitting system cart of claim 1, wherein the first door panel includes a retaining rack for golf club shaft grips located on the inside of the first door panel.

6. The fitting system cart of claim 1, wherein the first door panel includes a retaining slot for golf club grip tape located on the inside of the first door panel.

7. The fitting system cart of claim 1, wherein the second door panel includes a shelf.

8. The fitting system cart of claim 1, wherein the first door panel and the second door panel include a locking mechanism.

9. The fitting system cart of claim 1, wherein the case includes a handle.

10. The fitting system cart of claim 1, wherein the case includes a locking mechanism.

11. The fitting system cart of claim 1, wherein each compartment comprises:

a baseplate;

a back wall connected to the baseplate, extending upward, generally perpendicular from the baseplate;

a first side wall connected to the baseplate and back wall, extending upward, generally perpendicular from the baseplate;

a second side wall connected to the baseplate and the back wall, extending upward, generally perpendicular from the baseplate; and a retaining portion which spans from the first side wall to the second side wall on the side away from the back wall.

12. The fitting system cart of claim 1, wherein the compartments include a first outer compartment, a second outer compartment, a first inner compartment, and a second inner compartment, and further, wherein the first outer compartment is connected to the first inner compartment, the first inner compartment is connected to the second inner compartment, and the second outer compartment is rotatably connected to the second inner compartment.

13. The fitting system cart of claim 12, wherein when the shaft container is in the first configuration, the two outer compartments are rotated to a closed position against the two inner compartments, the cover is rotated over the top of the compartments, and the stand is in the retracted configuration.

14. The fitting system cart of claim 12, wherein when the shaft container is in the second configuration, the two outer compartments are rotated to an open position proximal to the two inner compartments, the cover is rotated back and against the back wall of the inner compartments, and the stand is in the extended configuration.

* * * * *